US006392514B1

(12) United States Patent
Kawata et al.

(10) Patent No.: US 6,392,514 B1
(45) Date of Patent: May 21, 2002

(54) TERMINAL UNIT FOR MULTIPOLAR SWITCH

(75) Inventors: Hisao Kawata; Naoshi Uchida; Katsunori Kuboyama; Mitsuyoshi Yamazaki, all of Saitama (JP)

(73) Assignee: Fuji Electric Co., Ltd., Kawasaki (JP)

( * ) Notice: Subject to any disclaimer, the term of this patent is extended or adjusted under 35 U.S.C. 154(b) by 0 days.

(21) Appl. No.: 09/731,227

(22) Filed: Dec. 7, 2000

(30) Foreign Application Priority Data

Dec. 13, 1999 (JP) ..... 11-353201

(51) Int. Cl.[7] ..... H01H 67/02
(52) U.S. Cl. ..... 335/132; 335/202; 439/810
(58) Field of Search ..... 335/6, 132, 202, 335/8–10; 200/293–312; 439/810–814

(56) References Cited

U.S. PATENT DOCUMENTS 4,146,855 A * 3/1979 Schultz et al. ..... 335/8
4,620,076 A * 10/1986 Mrenna et al. ..... 200/304
4,905,122 A * 2/1990 Culnan et al. ..... 361/376
5,304,761 A * 4/1994 Rosen et al. ..... 335/201

* cited by examiner

*Primary Examiner*—Lincoln Donovan
(74) *Attorney, Agent, or Firm*—Kanesaka & Takeuchi

(57) ABSTRACT

A terminal unit having connection conductors to be connected to corresponding terminals of a switch is installed in a terminal section of the switch, and an external electric wire is connected to each terminal section of the connection conductors. Thus, the insulation distance between phases for the terminal sections and the insulation distance between the terminal section and a panel cut surface are increased according to the requirement of the switch. The shape and size of the terminal unit can be set regardless of the switch, so that a required insulation distance is obtained without increasing the size of the switch main body.

6 Claims, 3 Drawing Sheets

TERMINAL UNIT FOR MULTIPOLAR SWITCH

BACKGROUND OF THE INVENTION AND RELATED ART STATEMENT

The present invention relates to a multipolar switch, such as a molded-case circuit breaker, including power supply-side and load-side polar terminals arranged adjacent to each other at front and rear sides of an insulated box, and in particular, to a terminal unit for increasing the insulation distance between the phases for the power supply-side terminals.

Conventionally, the insulation distance between the terminals is determined by the shapes of the case and cover forming an insulated box of a switch. That is, to increase the insulation distance between the terminals, the size of the interphase partition wall is increased, and to increase the insulation distance between a board panel on which the switch is mounted and the terminal, a panel cut surface of a cover, i.e. a top surface of the cover which contacts the board panel, is located higher than the terminal surface.

However, the required insulation distance varies according to the standards for the switches. Thus, the dimensions of the insulated box are conventionally determined so as to obtain a maximum insulation distance prevailing among the standards. On the other hand, it has been required to reduce the outside dimensions of the switch, and an insulated box smaller than that of the standard size is used for the application that does not require the maximum insulation distance. As a result, two types of the insulated boxes must conventionally be provided, depending on the required insulation distance.

It is thus an object of the present invention to reduce the size of a switch while allowing the insulation distance to be easily increased.

SUMMARY OF THE INVENTION

To attain this object, according to the present invention, a terminal unit having a greater insulation distance than a switch main body is installed in a multipolar switch including power supply-side and load-side polar terminals arranged at front and rear sides of an insulated box and adjacent to one another. The insulated box comprises a case, and a cover having a screw-tightening opening immediately above the polar terminals.

The terminal unit comprises polar connection conductors each having a connection section at one end connected to the terminal and a terminal section at the other end thereof to which an electric wire is connected, and an insulated housing for allowing the connection sections of these connection conductors to project outwardly and surrounding the terminal sections. An interior of the insulated housing is partitioned into wiring spaces for each pole by means of interphase partition walls. Each wiring space has a closed end from which the connection section projects, and a wire insertion port opened at an opposite end thereof. A wire passage is formed between the wire insertion port and the terminal section for guiding the electric wire. The insulated housing has a screw-tightening opening immediately above the terminal section, and is installed at the power supply-side end of the insulated box so as to cover the screw tightening holes in the case.

In this structure, it is possible to install the terminal unit having the insulation distance between terminals for the connected conductors and the insulation distance between the terminal and a panel cut surface appropriately determined based on the shape of the insulated housing in the insulated box of the switch, and to allow the insulation distance greater than that of the switch main body, as required.

Preferably, each connection conductor has a step such that its terminal section side is lower than its connection section side. Thus, the step serves to increase the insulation distance between the terminal and the panel cut surface.

Preferably, inclinations are formed in top and bottom wall surfaces of the wire passage to guide electric wires toward the terminal section. Thus, even if the wire passage is elongated to increase the insulation distance, the electric wires can easily be inserted into the terminal unit. Additionally, insulation distance can be effectively increased by forming multiple vertical grooves along the side wall surfaces of the wire passage.

DETAILED DESCRIPTION OF PREFERRED EMBODIMENT

Figure 1:
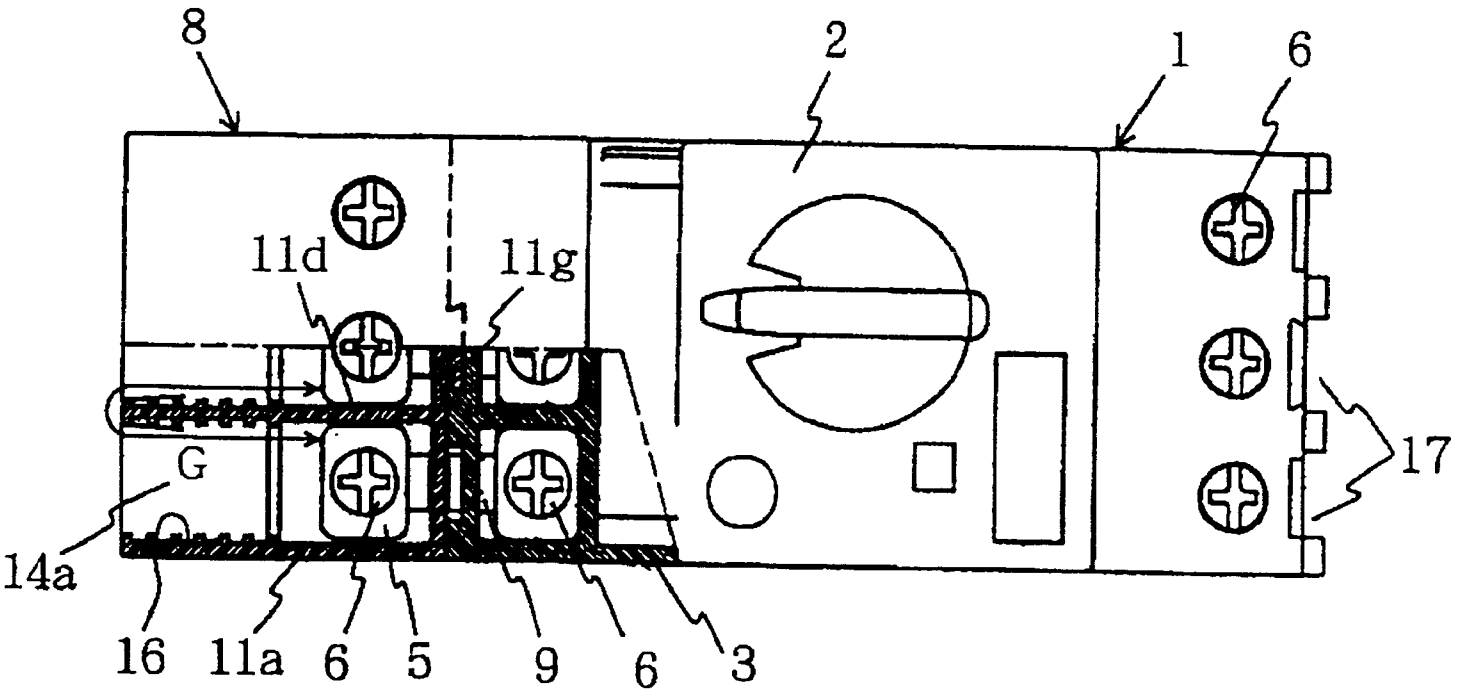
FIG. 1 is a partly broken plan view of a switch showing an embodiment of the present invention.
Figure 2:
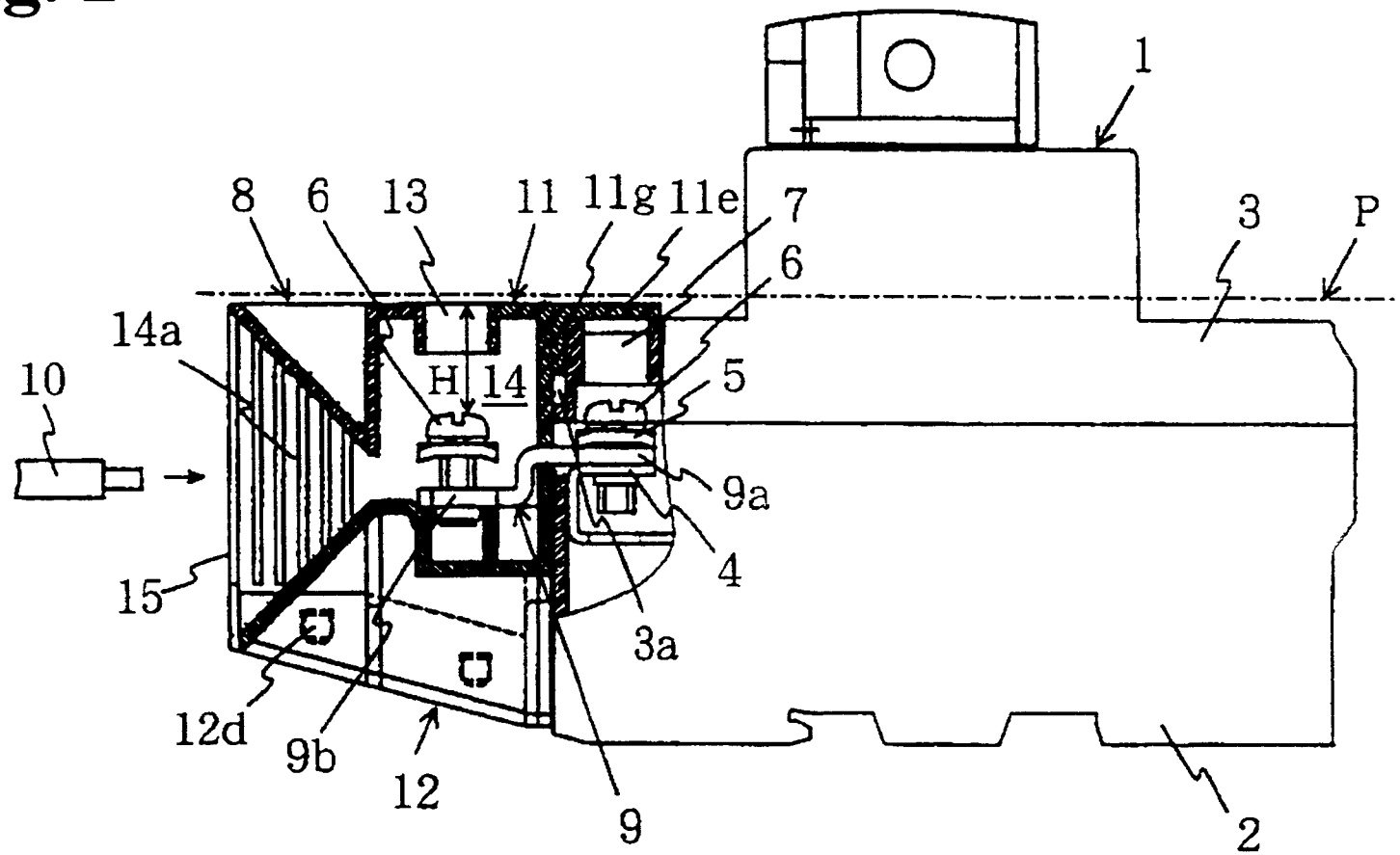
FIG. 2 is a partial vertical sectional view of FIG. 1.

FIGS. 1 to 3 show an embodiment of the present invention.

Figure 3A:
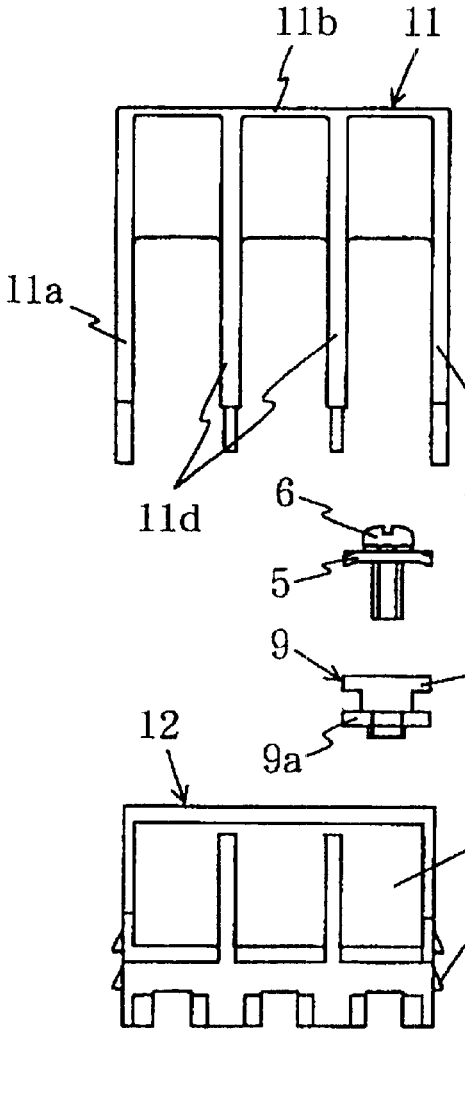
FIG. 3(A) is an exploded front view of a terminal unit.
Figure 3B:
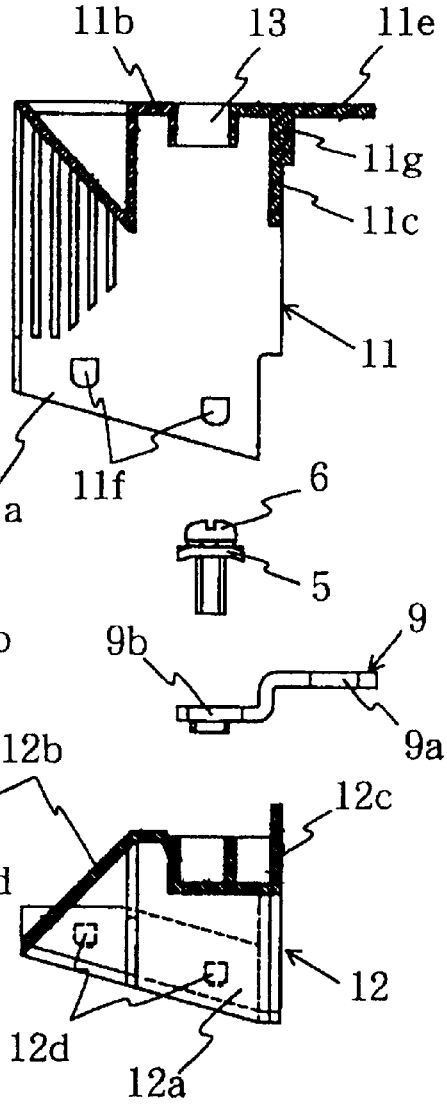
FIG. 3(B) is an exploded vertical sectional view thereof.

FIG. 1 is a plan view showing a partly broken three-pole switch with a terminal unit installed therein. FIG. 2 is a partial vertical sectional view of FIG. 1. FIG. 3(A) is an exploded front view of the terminal unit, and FIG. 3(B) is an exploded vertical sectional view thereof.

In FIGS. 1 and 2, a switch 1 comprises an insulated box formed of a mold case 2 and a mold cover 3, in which movable and fixed contact shoes, a switching mechanism, an excess current-tripping device, and so on are retained, and power supply-side (at the left of the figures) and load-side (at the right of the figures) terminals 4 (only the power supply-side terminals are shown) arranged at the front and rear sides of the insulated box adjacent to one another via interphase partition walls. Each of the terminals 4 has a terminal screw 6 with a washer 5, and a top wall of the mold cover 3 forming a panel cut surface P has a screw-tightening opening 7 to allow the terminal screw 6 to be tightened with a screwdriver.

In FIGS. 1 to 3, the terminal unit 8 comprises polar connection conductors 9, each having a connection section 9*a* at one end to be connected to the terminal 4 and a terminal section 9*b* at the other end to which an electric wire 10 is connected, and an insulated housing for allowing the connection sections 9*a* of the connection conductors 9 to project outwardly and to surround the terminal sections 9*b*. The insulated housing is formed of a molded resin, and is vertically divided into a unit cover 11 and a unit case 12. The terminal section 9*b* has the same terminal screw 6 as that of the terminal 4. The connection conductor 9 has its intermediate portion bent in a Z-shape so as to have a step such that the terminal section 9*b* side is lower than the connection section 9*a* side.

The unit cover 11 comprises an enclosure formed of left and right side walls 11*a* and 11*a*, a top wall 11*b* extending therebetween, and a front wall 11*c*, and interphase partition walls lid are integrally formed inside the enclosure. In addition, a cover plate 11*e* that covers the screw-tightening openings 7 in the switch 1 is integrally formed at an extension of the top wall 11*b* as to extend frontward (rightward in FIG. 2). Further, the top wall 11*b* has screw-tightening openings 13 immediately above the terminal screws 6 of the terminal sections 9*b* for allowing a screw-driver to be inserted therethrough to tighten the terminal screws 6.

The unit case 12 comprises an enclosure formed of left and right side walls 12*a*, a bottom wall 12*b* and a front wall 12*c* extending between the side walls 12*a*. As shown in FIG. 2, the unit case 12 is internally combined with the unit cover 11 to have the connection conductors 9 therebetween, and is coupled thereto by means of snap-fitted engagement between claws 12*d* (FIG. 3) integrally formed on the outside of the side walls 12*a* at two longitudinal positions and openings 11*f* formed in the side walls 11*a* of the unit cover 11 so as to correspond to the claws 12*d*. The interior of the insulated housing formed by this coupling is partitioned into spaces 14 for each pole by means of interphase partition walls 11*d*. Each space 14 for each pole has an end closed by the front walls 11*c* and 12*c* from which the connection section 9*a* projects, and has a wire insertion port 15 opened at the opposite end thereof. A wire passage 14*a* is formed between the wire insertion port 15 and the terminal section 9*b* to guide an electric wire 10 to the terminal section 9*b*.

In FIG. 2, the top and bottom wall surfaces of the wire passage 14*a* are inclined to guide the electric wire 10 from the wire insertion port 15 toward the terminal section 9*b*, so that the wire passage 14*a* is formed like a trumpet, as seen from the side of the unit. In addition, the side walls 11*a* and the partition walls 11*d* of the unit cover 11 forming side walls of the wire passages 14*a* have multiple grooves 16 (FIG. 1) formed in a vertical direction relative to the unit.

The above-described terminal unit 8 is installed in the switch 1 as described below. First, the polar connection conductors 9 are fixed to the corresponding power supply-side terminals 4 of the switch 1 via the connection sections 9*a* using the terminal screws 19) 6. Then, the unit cover 11 is connected to the cover 3 of the switch 1. In this regard, the front wall 11*c* of the unit cover 11 has an engagement projection with a dovetailed cross section vertically formed integrally therewith at a center thereof, and the cover 3 correspondingly has an engagement groove 3*a* of the same shape in an end surface thereof. Then, the unit cover 11 is coupled as shown in the figures by inserting the engagement projection 11*g* into the engagement groove 3*a* from above to allow the cover plate 11*e* to abut on a top surface of the cover 3 and to allow a lower end surface of the front wall 11*c* to abut on the top surfaces of the connection conductors 9. In this state, the cover plate 11 comes to tight contact with the top surface of the cover 3 to cover the screw-tightening openings 7.

The unit case 12 is subsequently inserted into the unit cover 11 from below and the claws 12*d* are engaged with the corresponding openings 11*f* in a snap-fitted manner to couple the unit case 12 and the unit cover 11 together. In this state, the front wall 12*c* of the unit case 12 abuts against the bottom surfaces of the connection conductors to cover the end surfaces of the case 2 and the cover 3, together with the front wall 11*c* of the unit cover 11.

In the switch 1 with the terminal unit 8 installed therein, as shown in FIGS. 1 and 2, the insulation distance between the phases of the terminals 4 of the switch I and the insulation distance between each terminal and the panel cut surface P can be substituted with the insulation distance G (FIG. 1) between the terminal sections 9*b*, more precisely, the washers 5, of the terminal unit 8, and the insulation distance H (FIG. 2) between the panel cut surface P and each terminal section 9*b*, more precisely, the terminal screw 6. The distances G and H of the insulation can be set at appropriate required values without restrictions dependent on the shapes or size of the case 2 or cover 3 of the switch main body.

In this case, the insulation distance G can be effectively increased by forming the multiple vertical grooves 16 in the side wall surfaces of the wire passages 14*a*, as shown in the figures. The insulation distance H can also be easily extended by forming the step in the connection conductor 9 to lower the terminal section 9*b* side with respect to the connection section 9*a*. Although not clearly shown, the case 2 and the cover 3 have recesses 17 in a power supply side (at the left of FIG. 1) end surface similarly to the load side (at the right of the same figure), and the unit cover 11 and the unit case 12 have projections on the surfaces thereof opposite to the case or the cover, the projections tightly engaging the corresponding recesses 17. Due to the tight contact between these engagement sections, even if a small gap is formed between the end surface of the switch 1 and the terminal unit 8, the interphase insulation does not decrease.

As described above, according to the preset invention, the terminal unit serves to create a large insulation distance without lo enlarging the insulated box of the switch main body, thereby obtaining a required maximum insulation distance without increasing the size of the switch. As a specific example, the installation of the terminal unit according to the present invention can increase the insulation distance between the phases, and the insulation distance between the panel cut surface and the terminal to 50.8 and 12.7 mm, respectively, from their original values of 12.7 and 9.7 mm.

While the invention has been explained with reference to the specific embodiment of the invention, the explanation is illustrative and the invention is limited only by the appended claims.

What is claimed is:

1. A terminal unit to be attached to a multipolar switch having a plurality of terminals, comprising:

a plurality of polar connection conductors, each having a connection section at one end to be connected to one terminal of the switch and a terminal section at the other end thereof to which an electric wire is to be connected; and an insulating housing surrounding the terminal sections so that the connection sections extend outwardly therefrom and formed of a cover section and a case section assembled together, said housing covering the terminals of the switch when the housing is attached to the switch and including at least one interphase partition wall for dividing an interior of the insulating housing into wiring spaces separated from each other so that one wiring space has one terminal section, an end wall for closing the wiring spaces while allowing the connection conductors to pass between the cover section and the case section, wire insertion ports each being opened at a side opposite to the end wall, wire passages each being formed between one wire insertion port and one terminal section for guiding the electric wire to the one terminal section, and openings formed in the insulating housing above the respective terminal sections.

2. A terminal unit according to claim 1, wherein each of said connection conductors has a step such that the terminal section is located lower than the connection section.

3. A terminal unit according to claim 1, wherein said insulating housing further includes top and bottom walls to form the wire passages, said top and bottom walls being inclined to gradually open outwardly to guide the electric wire toward the terminal section.

4. A terminal unit according to claim 3, wherein side walls forming the wire passage include multiple grooves formed vertically along side wall surfaces of the wire passage.

5. A terminal unit according to claim 1, wherein said cover section and the case section include engaging means for securely engaging the same, and at least one of the cover section and the case section includes a connecting device for connecting the at least one of the cover section and the case section to the multipolar switch.

6. A terminal unit according to claim 1, further comprising screws fixed to the terminal sections for connecting the electric wires to the terminal sections, each of said openings having a size to allow a tool for rotating the screw to pass therethrough.

* * * * *

UNITED STATES PATENT AND TRADEMARK OFFICE

CERTIFICATE OF CORRECTION

PATENT NO. : 6,392,514 B1
DATED : May 21, 2002
INVENTOR(S) : Hisao Kawata et al.

It is certified that error appears in the above-identified patent and that said Letters Patent is hereby corrected as shown below:

Column 3,
Line 29, delete “19)”;

Column 4,
Line 25, change “preset” to -- present --; and
Line 27, delete “lo”.

Signed and Sealed this

First Day of October, 2002

*Attest:*

*Attesting Officer*

JAMES E. ROGAN
*Director of the United States Patent and Trademark Office*